United States Patent [19]

Meier

[11] 4,361,738

[45] Nov. 30, 1982

[54] KEY-ACTUATED SWITCH

[75] Inventor: James Meier, Des Plaines, Ill.

[73] Assignee: Norlin Industries, Inc., White Plains, N.Y.

[21] Appl. No.: 156,364

[22] Filed: Jun. 4, 1980

[51] Int. Cl.[3] ..... H01H 21/00; H01H 1/12

[52] U.S. Cl. ..... 200/6 R; 84/423 R; 84/DIG. 7; 200/276; 200/283; 200/292

[58] Field of Search ..... 200/5 R, 5 A, 6 R, 251, 200/276, 275; 368/319, 320, 321; 84/DIG. 7, 423 A, 433, 434, 435

[56] References Cited

U.S. PATENT DOCUMENTS

| | | | |
|---|---|---|---|
| 2,577,468 | 12/1951 | Knös | 200/275 X |
| 2,823,251 | 4/1958 | Hayslett . | |
| 2,852,973 | 9/1958 | Corbett, Jr. . | |
| 3,060,784 | 10/1962 | Holt | 200/275 X |
| 3,193,607 | 7/1965 | Anderson | 200/5 R X |
| 3,330,176 | 7/1967 | Schwartz et al. . | |
| 3,388,229 | 6/1966 | Lyvang | 200/249 |
| 3,619,532 | 11/1971 | Lyvang | 200/275 |
| 3,746,820 | 7/1973 | Holder, Jr. . | |
| 3,860,776 | 1/1975 | Lockard | 200/276 |
| 4,051,665 | 10/1977 | Arn | 368/319 |
| 4,099,037 | 7/1978 | Hartzler et al. | 200/5 A |

FOREIGN PATENT DOCUMENTS

| | | | |
|---|---|---|---|
| 829965 | 3/1960 | United Kingdom | 200/276 |

*Primary Examiner*—James R. Scott

*Attorney, Agent, or Firm*—Ronald J. Kransdorf

[57] ABSTRACT

This is an electrical switch mechanism actuated by a piano-style key of a musical instrument. The switch consists of a pair of cross-bar contacts, at least one of which is resiliently flexible. This resilience permits a moveable contact member to be driven into engagement with a fixed contact member, and also keeps it firmly biased against the fixed contact member for electrical communication therewith whenever the key is in its actuated position. When the key is released, an actuator member on the key captures the moveable contact and moves it away from the fixed contact. Upon actuation, the key over-travels beyond the point of contact engagement, but the actuator decouples from the contact so as to avoid any increase in contact pressure and prevent double-keying. Various techniques for minimizing impact noise during contact recapture, and for mounting the contacts upon a circuit board, are also disclosed.

15 Claims, 9 Drawing Figures

FIG. 1
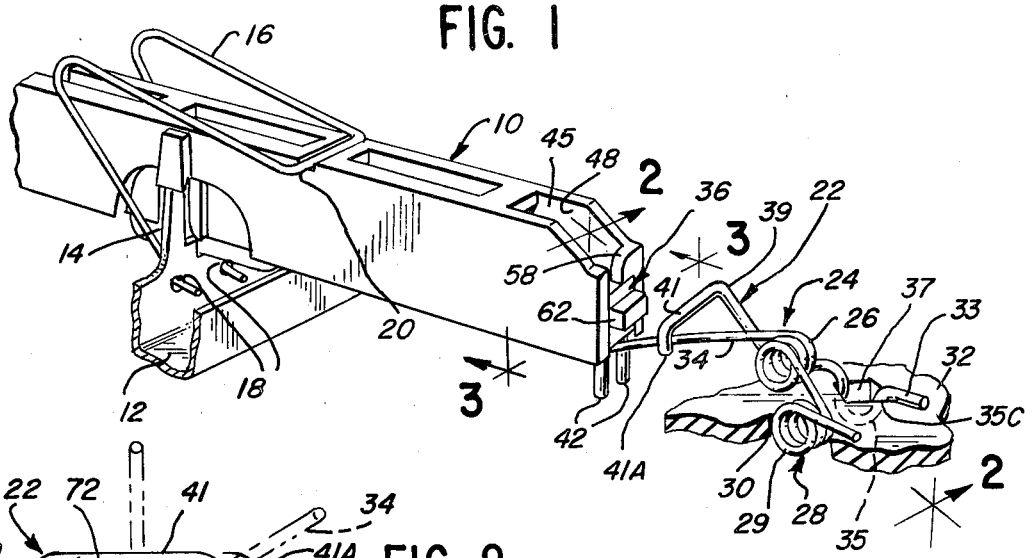
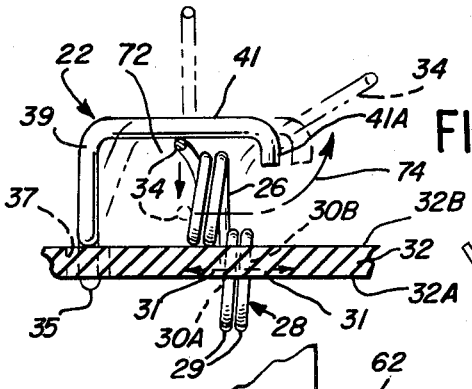
FIG. 8
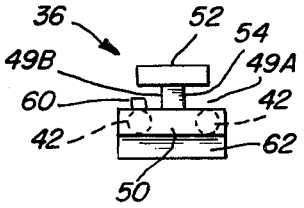
FIG. 9
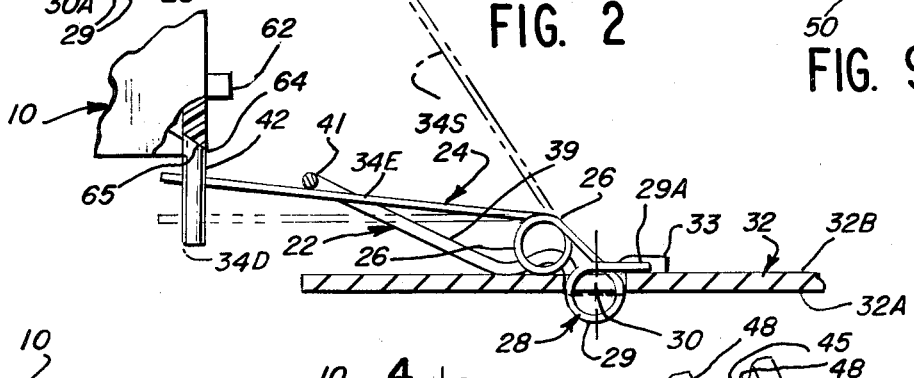
FIG. 2
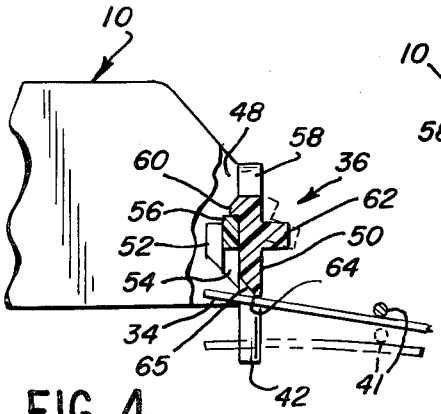
FIG. 4
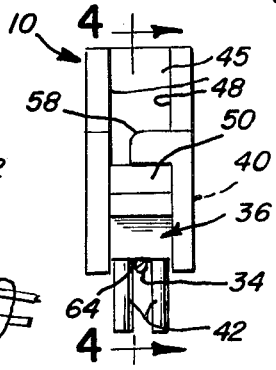
FIG. 3
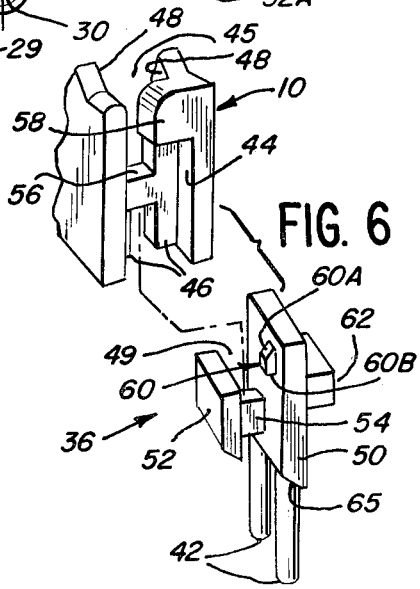
FIG. 6

FIG. 5
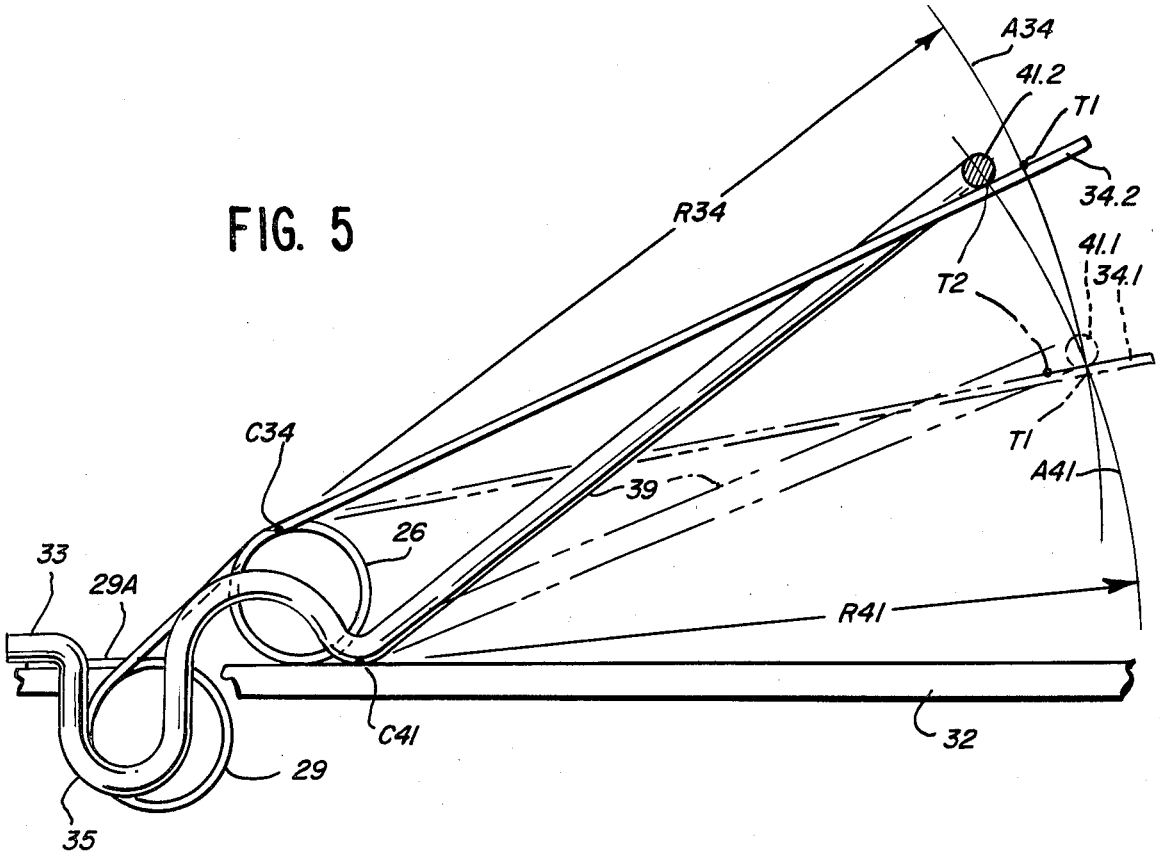
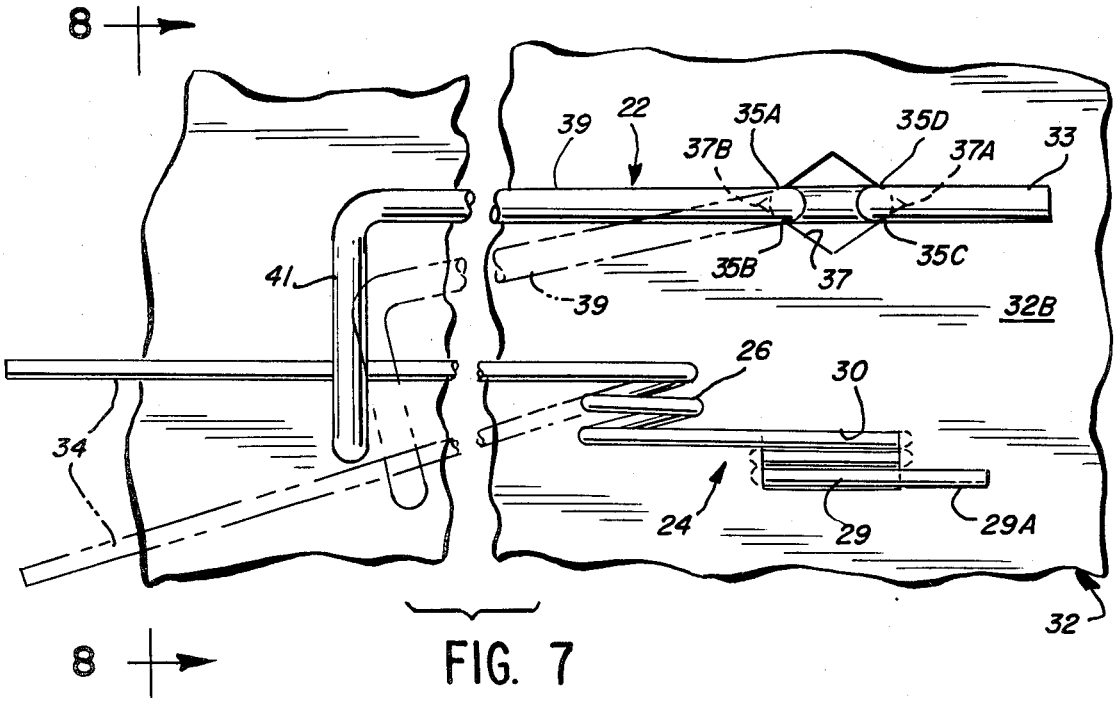
FIG. 7

KEY-ACTUATED SWITCH

This invention relates to electrical switches of the type employed in the keyboards of electronic musical instruments.

BACKGROUND AND PRIOR ART

Electronic organs, synthesizers and other electronic musical instruments employ piano-style keyboards wherein a pair of normally open electrical switch contacts is closed whenever a key is actuated. In this environment it is preferable that the switch close before the key completes its actuating stroke. As the key travels past the switch closure point, however, certain problems can arise.

In prior art key switch designs the key remains coupled to the moveable switch contact after switch closure occurs. As a result, travel of the key past the closure point (over-travel) presses the moveable contact against the fixed contact with a force which continues to increase until the key finally completes its excursion. For several reasons, this is not desirable.

While a certain level of contact pressure is of course essential to assure completion of the electrical circuit, it is not desirable for the contact pressure to increase greatly beyond that level. Additional contact pressure causes an excessive amount of contact wiping. Some wiping action is desired in an electrical switch mechanism, because it tends to scrub off surface impurities and thus promote bare metal contact. But if the wiping action occurs under excessive pressure, it results in rapid wear at the contact point. In the electronic musical instrument field, switch contacts are commonly clad or plated with precious metals to prevent corrosion and thus enhance circuit reliability. Wear eventually removes the precious metal layer from the surface of the contacts, and leaves them vulnerable once again to corrosion. If this wearing process is too rapid, it unduly shortens the useful life of the switch mechanism.

Then, too, excessive wiping action can cause problems in relation to the operation of the electronic circuitry of the instrument. Some of this circuitry is designed to respond to small input voltage levels received from the keyboard switches. Excessive wiping action, in conjunction with small surface asperities on the switch contacts, can produce multiple switch closures for a single key actuation, and the musical instrument then sounds the note a plurality of times (double keying), instead of only once as the musician intended. This is particularly a problem with certain types of electronic organ voices, such as "solo percussion."

After the key stroke is completed, if the musician continues to hold the key down in order to play a sustained note, he may move the key slightly from side to side while holding it down. If the key remains coupled to the moveable contact during hold-down, this sideward movement of the key may be transmitted to the moveable contact, which will then move back and forth across the surface of the fixed contact. Movements such as these cause wear, and can also cause signal interruptions. Double keying again results, causing the instrument to repeat the note rapidly instead of playing it only once for a sustained interval.

One way of dealing with these problems is to use a low resilience moveable contact member, such as a relatively limp coil spring. Such springs are so compliant that they minimize the above-described problems which occur during over-travel and hold-down of the keys. But the winding of a coil spring requires a considerable length of precious-metal-covered wire; and so this approach is costly.

BRIEF SUMMARY OF THE INVENTION

The key-actuated switch mechanism of this invention is designed so that the key uncouples from the moveable switch contact after the latter engages the fixed switch contact. As a result there is no increase in contact pressure as a function of key over-travel, and this reduces contact wiping and wear. It also precludes the possibility of double-keying through contact wiping, even if the musician should vibrate the key laterally during a sustained note.

In the mechanism of this invention a moveable switch contact arm is biased toward a static position. Actuating means move with a key to engage the moveable arm, and transport it toward a displaced position. Later, when the key goes from a rest position toward an actuated position, the actuating means permits the moveable switch arm to return toward its static position in response to the bias force. A fixed contact is positioned to engage the moveable contact arm after the latter has moved part of the way, but not all of the way, toward its static position. The fixed contact then blocks further movement of the moveable contact arm toward its static position. The key must travel further, beyond the point of contact engagement, in order to reach its fully actuated position. During such key overtravel, the actuator uncouples from the moveable contact arm, leaving it biased against the fixed contacct. Later, the key is biased back toward its rest position, whereupon the actuator returns, re-engages the moveable contact arm, and drives it back to its displaced position.

In a particular embodiment of the invention, the moveable contact arm comprises the free end of a resilient conductive wire which extends into the path of the actuator means, and is moved resiliently toward its displaced position. The inherent resilience of this wire provides the force which biases the arm toward its static position, and which presses it against the fixed contact during over-travel of the key.

In order to achieve a small, controlled amount of contact wiping, the fixed contact comprises a resilient member which yields slightly when the movable contact bias force is brought to bear upon it.

In order to secure the fixed contact member in place, it is mounted upon a base or circuit board in a unique way, which involves the insertion of an oversized loop of wire into an opening with at least two diagonally opposite vertices.

A unique way of mounting the moveable contact member on the base or circuit board is also employed. This involves the use of one or more turns of resilient wire which is received within an undersized slot. This serves to retain the contact member at least temporarily in assembly with the slotted board.

The contact members are arranged so that the moveable contact arm can be released from engagement with the fixed contact arm, its spring pressure adjusted, and then returned to its operating position. The fixed contact arm can be adjusted laterally so as to distribute the wear resulting from contact wiping, and vertically so as to select the point at which electrical contact is made.

Re-coupling of the key assembly to the moveable contact arm each time an actuated key is released is a potential source of impact noise. Such noise can be a serious drawback in the playing of a musical instrument. The key itself is customarily molded of a hard plastic material which cannot impact directly upon a metallic key switch element without producing such noise. If the key were made of a softer material, it would not have adequate strength and rigidity. A separate actuator member is provided, however, which is made of a softer, more sound-absorbing material. This actuator is arranged to absorb all of the switch element impact.

The actuator is also formed with a narrow impact edge, which further minimizes the noise created upon re-coupling of the switch element.

The actuator is formed in such a way as to mate with complementary receiving surfaces on the key, and preferably there are interengaging means on the key and the coupling member which latch the two together. The choice of a soft material for the actuator member has the further advantage that it permits the actuator to flex so that latching and unlatching takes place when it is assembled with the key or is removed therefrom.

BRIEF DESCRIPTION OF THE DRAWINGS

FIG. 1 is a perspective view, with parts broken away for clarity of illustration, of a single keyswitch mechanism constructed in accordance with this invention.

FIG. 2 is a fragmentary side elevational view, with parts sectioned for clarity of illustration, of the same keyswitch mechanism, and showing various positions of the moveable switch contact arm.

FIG. 3 is a rear elevational view of portions of the same keyswitch mechanism.

FIG. 4 is a side elevational view, with parts sectioned for clarity of illustration, of a portion of the same keyswitch mechanism, showing two operating positions of the switch contact members.

FIG. 5 is an enlarged side elevational view of the switch contact members of the same keyswitch mechanism, showing multiple positions thereof in order to illustrate the contact wipe motion which occurs upon making and breaking of the circuit.

FIG. 6 is an exploded perspective view of the actuator member and the rear end of the key employed in this keyswitch mechanism.

FIG. 7 is an enlarged top plan view of the printed circuit board and the switch contact members of this keyswitch mechanism, showing various positions of the contact members in order to illustrate methods of adjusting the spring force and contact point.

FIG. 8 is a sectional view, taken along the lines 8—8 of FIG. 7, of the circuit board and contact members of this keyswitch mechanism, again showing different positions of the contact arms in order to illustrate the same methods of adjustment.

FIG. 9 is a top plan view of the actuator member employed with this keyswitch mechanism.

DETAILED DESCRIPTION OF THE PREFERRED EMBODIMENT

Key-actuated switch mechanisms in accordance with this invention would normally be incorporated into a musical instrument keyboard comprising a plurality of piano-style keys, each of which is mounted for pivotal movement upon the frame of the instrument. For clarity of illustration, only one such keyswitch mechanism is shown herein. A piano-style key 10 is supported upon a channel-shaped member 12 having pairs of upstanding tabs 14 (only one tab is visible in the drawings) which serve as fulcrums for the pivotal motion of the key. A flexure spring 16 straddles the key and has its ends anchored in apertures 18 formed in the channel member 12 below the tabs 14. The spring 16 exerts a biasing force which tends to rotate the key 10 clockwise about the fulcrum tabs 14 (relative to the view of FIG. 1) toward a rest position. For further details of the construction of such a key mechanism, the reader may refer to U.S. Pat. No. 4,128,035; and for a more detailed description of the biasing spring mechanism 16, the reader may refer to my co-pending Patent application Ser. No. 133,562, entitled "Keyboard Spring Return Mechanism" filed Mar. 24, 1980.

A switch, which breaks and makes an electrical circuit when actuated by the key 10, comprises a so-called "fixed" contact member 22 and a moveable contact member 24, both mounted upon a base such as a printed circuit board 32 formed of an electrically insulating material. These switch members are formed of respective metal wires which are both resiliently flexible (but not to the same extent), and are preferably covered (e.g. clad or plated) with gold, silver or some other precious metal in order to prevent corrosion and thus enhance circuit reliability.

The moveable contact member 24 has a fixed end 28 which is fixedly mounted on the circuit board 32, and a moveable arm 34 which extends toward the key 10.

In order to secure the moveable contact member 24 to the circuit board 32, and also to permit electrical connection to be made to the moveable contact member at the lower surface 32A of the board, the board is formed with a slot 30 having a pair of substantially parallel confronting sides 30A and 30B (FIG. 8) which extend in the same general direction as the longitudinal axis of the key 10 (hereinafter called the longitudinal direction). The fixed end 28 of moveable contact member 24 is wound to form one or more turns 29 (FIG. 8). Although two such turns are shown, the number can be anything from one to several. The turns are substantially helical in form, and are received within the slot 30. When two or more turns 29 are employed, they form a short coil spring, which is oriented with the axis of the helix extending laterally; that is, more or less perpendicularly to the longitudinal direction. The outside diameter of the turns 29 is large enough so that they can only be received within the longitudinal extent of the slot 30 when force-fit therein. The turns are pressed firmly downwardly into the slot, and in the process their diameter dimension is momentarily resiliently compressed. The radius of turns 29 somewhat exceeds the thickness of circuit board 32. Therefore, the center of the turns 29 eventually descends somewhat below the lower surface 32A of the circuit board, as seen in FIG. 2. At that point the turns 29 spring back part-way (but not all the way) toward their normal diameter; i.e. their diameter once again becomes larger than the longitudinal dimension of slot 30, but the turns 29 continue to exert a force on the longitudinally opposite ends of slot 30.

In addition, if there is more than one turn 29, these turns are initially spaced sufficiently far apart so that the axial length of the helical spring formed thereby is too long to fit within the lateral extent of slot 30. But when this coil spring is resiliently compressed (i.e. when turns 29 are pressed together) in the axial direction, the coil fits within the lateral extent of the slot 30 (between walls 30A and 30B) as seen in FIGS. 7 and 8.

Thus, the fixed end 28 of the moveable contact member is initially assembled with the circuit board 32 by axially compressing the coil spring formed by turns 29, and force-fitting these turns into slot 30. Insertion is limited when contact is made with upper surface 32B by a tip 29A of the last one of the turns 29, and by some additional coil turns 26 formed on the lower end 28, the purpose of which will be discussed shortly. After insertion, the turns 29 are released, whereupon they spring laterally outwardly (arrows 31 in FIG. 8) to exert axial forces on the slot walls 30A and 30B.

These axial forces help to retain the moveable contact member 24 in assembly with the circuit board 32 and also help to keep the free arm 34 oriented in a substantially longitudinal direction. The contact member 24 is also retained in place by virtue of the fact that the diameter of turns 29 is over-sized in relation to the longitudinal dimension of slot 30, and the fact that the center of these turns is below the bottom surface 32A of the circuit board, as described above. Thus a substantial amount of force is required to separate the moveable contact member 24 from circuit board 32, because the diameter of turns 29 must be recompressed in order to extract them from slot 30. In effect, the diameter of turns 29 makes an over-center snap fit with the longitudinal dimension of the slot 30.

The use of the coil turns 29 to secure the contact member 24 within the circuit board slot 30 makes it unnecessary to fill the slot with epoxy or some other adhesive substance to achieve that object during production, in contrast to prior art keyswitch structures. The elimination of the need for an adhesive makes the production process simpler and faster. Solder (not shown) is applied to the turns 29 directly below the slot 30, in order to connect the contact member 24 electrically to one of several printed circuit conductors (not shown) on the underside 32A of circuit board 32. The solder has the additional effect of permanently securing turns 29 to the board. The turns 29, however, are effective to hold the contact member 24 in place while awaiting the soldering operation.

The additional coil turns 26 serve the primary purpose of permitting the free arm 34 of contact member 24 to be displaced in a vertical direction (see positions 34S, 34E and 34D in FIG. 2), and also in a horizontal direction (see the several positions of arm 34 in FIGS. 7 and 8), for purposes which will soon be apparent.

As the arm 34 is raised and lowered, the coil turns 26 are resiliently opened and closed. This distributes the flexing stress over the entire linear extent of the turns 26, and thus reduces metal fatigue in order to provide greater durability. Another advantage of distributing the flexing stress in this manner is that the force required to actuate the key 10 is smaller, owing to the fact that the angle of deflection experienced by the coil turns 26, at any given point along their length, is inversely proportional to the total length of wire over which the binding stress is spread.

Horizontal displacement to either side causes the coil turns 26 to twist sidewardly, for example as seen in FIG. 7; and this, too, serves to distribute bending stress over a greater extent of wire length, thereby reducing fatigue and lengthening the life of the contact member 24.

The "fixed" contact member 22 is so called only because it remains relatively stationary while the free arm 34 moves into and out of engagement therewith for making and breaking the electrical circuit. However, it will be apparent later that the fixed contact member is also movable over a limited range under specified circumstances.

The fixed contact member has a lower end 33 and an upper end 39. The lower end rests on the upper surface 32B of the circuit board, and is formed with a depending loop 35 received within an opening 37 (FIG. 7) formed in the circuit board 32. This opening is shown with a diamond (rhomboid) shape, but it could also have a football shape or any similar configuration which includes corners 37A, and 37B located diagonally opposite each other along a line running in the longitudinal direction defined previously. The loop 35 is shown here as a half turn, but it could comprise any substantial fraction of a full turn. The half-turn has an outside diameter which is slightly oversized relative to the distance between corners 37A and 37B. The half-turn can therefore be force-fit into the opening 37 by compressing it slightly. Once in place (see FIGS. 1, 7 and 8) the half-turn exerts a strong longitudinally directed spring pressure on the walls of opening 37, which serves to retain the fixed contact member temporarily in assembly with the circuit board 32 during production.

The lower end of the half-turn 35 below the circuit board 32 will eventually be enveloped by a lump of solder in order to connect it electrically to one of the printed circuit conductors (not shown) on the lower board surface 32A. This retains the fixed contact member 22 permanently in assembly with the board; but prior to the soldering step the spring pressure of the half-turn upon the walls of the opening 37 is effective to hold the fixed contact member 22 in place.

The fixed contact member upper end 39 extends in a longitudinal direction alongside the free arm 34. The upper end 39 first rises upwardly from the board 32 at a slant (see FIG. 2), then bends laterally to form a horizontal bar 41 (FIGS. 2, 7 and 8) extending across the top of the free arm 34, and finally bends downwardly to terminate in a depending tip 41A. The horizontal bar 41 extends approximately at right angles to the free arm 34 so that these two members form a cross-bar type of switch in which the bar 41 remains relatively stationary while the arm 34 moves into and out of electrical contact therewith.

In order for the horizontal bar 41 to cooperate properly with arm 34, the bar must be held in a substantially horizontal attitude. If the bar 41 were substantially slanted, the arm 34 might skid upwardly along the resulting ramp at the time of contact closure. And such skidding motion would be primarily friction-limited, so that it's speed might become great enough to produce contact bounce, multiple contact closures, and double keying. The attitude of the fixed contact member 22 is therefore controlled, i.e., it is prevented from rotating about a longitudinal axis lying in the plane of the circuit board 32, by the way in which the half-turn or loop 35 engages the walls of the rhomboidal opening 37. As seen in FIG. 7, loop 35 is tangent to the walls of opening 37 at four separate locations 35A through D. Each pair of tangency locations 35A, B and 35C, D is spaced a short distance from one of the corners 37A, 37B. (See also FIG. 2). As a result, if a force were exerted to rotate the fixed contact member 22 in one direction about the aforesaid longitudinal axis, the loop 35 would be jammed against the side walls of opening 37 at tangency locations 35B and C; whereas a force in the opposite direction would jam the loop against the opposite walls of the opening 37 at tangency locations 35A and D. In either case, the effort to move the fixed contact member 22 out of its proper operating attitude would be resisted in this manner.

As best seen in FIG. 2, the moveable contact arm 34 is arranged so that if the horizontal bar 41 were not interposed in its path, the inherent resilience of the arm 34 would carry it upwardly to a static position 34S. Because of the presence of the horizontal bar 41, however, the arm 34 can only rise far enough to engage that bar; i.e., to an engaged position 34E. When the arm 34 is in this position, the two members 34 and 41 make electrical contact with each other, and the circuit is closed. Note that the moveable contact arm 34 is trapped laterally between the slanted portion of the upper end 39 on one side, and the depending tip 41A on the other side.

An actuator member 36 is secured to the rear surface of the key 10. The rear of the key is formed with a downwardly opening channel 44 (see FIG. 6). The key also has a hollow interior 45 (FIGS. 1, 3 and 6). Immediately forward of the channel 44 is a pair of downwardly extending rails 46 which project laterally inwardly (toward each other), and into the interior space 45, from confronting internal side walls 48. these rails are received within a vertically oriented space 49 located between a rear body 50 and a front body 52 of the actuator 36. A longitudinally oriented bridge member 54 connects these front and rear bodies, and is centrally located to divide the space 49 into two vertical channels 49A and 49B (FIG. 9) which mate slidably with respective rails 46 in tongue-and-groove fashion. In order to install the actuator 36 at the rear of the key 10, the actuator is inserted upwardly in such a way that the rear body 50 slides into channel 44, the rails 46 slide into channels 49A and 49B, and the front body 52 slides into interior space 45 at a location immediately forward of the rails 46. This upward insertion is limited by a bridge member 56 (FIGS. 4 and 6) which extends laterally between the rails 46, and abuts against the bridge member 54 immediately below it (see FIG. 4). It is also limited by a barrier member 58 extending laterally from one of the walls 48 across the top of channel 44.

The channels 49A and 49B are sized to make a light, slidable frictional fit with the rails 46. But to make the connection between actuator 36 and key 10 still more secure, a latch projection 60, formed on the forwardly facing surface of the rear-body 50 (FIGS. 4, 6 and 9), snaps over the top edge of bridging member 56 when the actuator slides into place. The latch projection 60, as seen in FIG. 4, has a trapezoidal profile including a slanted upper surface 60A and a horizontal lower surface 60B. This configuration makes it easier to engage the latch than to dislodge it accidentally.

The key 10 is molded of a plastic material. For reasons of strength and rigidity, the plastic is a hard material. But the actuator 36 is molded of a soft and relatively flexible plastic material. This enables it to flex rearwardly (see the dotted line position of actuator 36 in FIG. 4) as it slides into position, so that the latch projection 60 can slide past the bridging member 60. This flexibility also facilitates removal of the actuator 36 from the key 10 when necessary. A tab 62 projects rearwardly from the rear body 50, and serves as a convenient finger-nail ledge for flexing the rear body 50 backwardly (as illustrated in FIG. 4) to release the latch projection 60 from bridge 56, while simultaneously pressing downwardly thereon to slide the actuator 36 out of engagement with key 10.

A pair of tines 42 at the bottom of actuator 36 extend vertically downward therefrom on either side of the free arm 34, thus containing the arm against lateral displacement. A horizontal lower edge 64 (FIG. 4) of the rear body 50 engages the upper surface of free arm 34. After the key 10 has been actuated and released, as the biasing spring 16 rotates the key 10 clockwise (relative to the view of FIG. 1) toward its rest position, the actuator 36 descends from above the arm 34, captures it between the tines 42, and forces it downwardly to a displaced position 34D (FIG. 2). The inherent flexibility of coil turns 26 permit this displacement, without the need for any special suspension or other moving parts. When the arm is displaced to this position 34D, it is out of engagement with the fixed contact bar 41, and therefore the electrical circuit is open.

When the arm 34 is struck by the actuator 36, the soft, yieldable plastic material of the latter absorbs the impact relatively quietly, and thus avoids making a metallic click every time the key 10 is released. In addition, a surface 65 (FIGS. 2 and 4) at the lower portion of rear body 50 is beveled so as to minimize the thickness at edge 64 where inpact against the arm 34 occurs. This, plus the fact that edge 64 extends transversely relative to the length of arm 34, serves to minimize the surface area of impact. In effect, surface 64 is a soft, knife-like edge which mutes noise both by yielding on impact and by minimizing the impact area.

When the key 10 is depressed, it rotates counterclockwise with respect to FIG. 1, raising the actuator 36 upwardly and permitting the arm 34 to rise from its displaced position 34D to its engaged position 34E. This re-establishes contact with the bar 41 and recloses the circuit. The inherent resilience of coil turns 26 provides all the biasing force necessary to motivate this closing movement.

The moveable contact arm 34 actually has enough spring bias force exerted thereon to move further in the upward direction, all the way toward its static position 34S, except that the presence of the fixed contact bar 41 prevents that from happening. As a result, the excess biasing force on the moveable contact arm 34 serves to bias it into firm electrical contact with the fixed contact bar 41, so that the switch mechanism makes a reliable electrical closure upon actuation of the key 10.

After the moveable contact arm 34 reaches its engaged position 34E and makes electrical contact with the fixed contact bar 41, the counter-clockwise movement of the key 10 and the accompanying upward movement of the actuator 36 continue further, until the key over-travels to its fully actuated position, illustrated in FIG. 2. The fixed contact bar 41, however, blocks the moveable contact arm 34 and substantially prevents it from following this over-travel movement of the key. As a result, the actuator 36 becomes uncoupled from the moveable contact arm 34, leaving it behind and in electrical engagement with the fixed contact bar 41. Consequently, the overtravel of the key 10 has no effect upon the contact pressure between the moveable contact arm 34 and the fixed contact bar 41.

That contact pressure is determined by the inherent resilience of the coil turns 26. This is an advantage over prior art key-actuated switch mechanisms, in which the extent of the key over-travel proportionately increases contact pressure, and in many cases causes excessive contact wiping action. Here the over-travel of the key cannot cause wiping of the contact members 34 and 41, nor can it cause them to move laterally in relationship to each other after electrical contact is made.

These features help prevent double-keying and consequent spurious operation of the musical tone-producing circuitry. Even if the musician should hold the key 10 down in its counter-clockwise actuated position, and vibrate it from side to side during the playing of a sustained tone, the de-coupling of actuator 36 from the moveable contact arm 34 prevents such movement from being transmitted to the switch mechanism. Thus, double-keying and excessive wear of the contact members 34 and 22 is prevented.

In order to insure subsequent re-capture of the moveable contact arm 34 by the actuator 36, the depending tines 42 are made long enough so that, even when the key is in its fully actuated position of FIG. 2, the tines depend below the engaged position 34E of the moveable contact arm, as illustrated in that Figure. Therefore, in order to insure that lateral vibration of the key 10 by the musician will not be transmitted to the moveable contact arm 34, the lateral spacing between the tines 42 must exceed the maximum amplitude of lateral motion of actuator 36 which can be achieved by vibrating the key 10 from side to side.

When the musician releases the key 10, it rotates clockwise relative to the view of FIG. 1, about its fulcrum tabs 14. This causes the actuator 36 to descend toward the moveable contact arm 34. At a certain point in the descent of the coupling member 36 (see FIG. 4), the edge 64 of the actuator again captures the moveable contact arm 34, and lowers it from the engaged position 34E to the displaced position 34D of FIG. 2, thus reopening the electrical circuit. The final released position of key 10 and disengaged position of moveable contact arm 34 are seen in FIG. 1.

Upon engagement and disengagement of the members 34 and 41 there is a certain amount of desirable wiping action; but it is a small, controlled amount, and it does not occur under pressure from the key 10. This wiping action is attributable to the fact that the upper end 39 of the fixed contact member 22 is slightly flexible. The degree of flexibility, and thus the amount of contact wipe, is limited by making the fixed contact member 22 of a heavier gauge wire, preferably in the neighborhood of twice the diameter, as compared to the wire of which the moveable contact member 24 is formed. As a result, the upper end 39 is relatively stiff. But it does flex somewhat in response to engagement and disengagement of the moveable contact arm 34 and fixed contact bar 41. As a result, the bar 41 and the arm 34 really have a range of engaged positions, the extremes of which are illustrated in FIG. 4. The lower positions illustrated therein show the arm 34 and bar 41 as they first make contact when the arm 34 is allowed to rise by actuator 36 and key 10. Later, when the key is in its over-travel phase and the actuator is de-coupled from arm 34, the upward spring pressure exerted by that arm causes it to drive bar 41 a short distance upwardly until these elements reach the higher of the two positions illustrated in FIG. 4. But the relative stiffness of the upper end 39 limits this motion to a fairly small displacement.

FIG. 5 illustrates the fact that the two contact elements 34 and 41 undergo a mutual wiping motion during the time when they are moving from their lower, or initial, contact positions 34.1 and 41.1 to the upper, or final, contact positions 34.2 and 41.2 respectively. In moving from position 34.1 to position 34.2 the arm 34 of the moveable contact member 24 rotates about a center substantially at location C34 at the top of the turns 26. A given point of tangency T1 on the arm 34, which is located at a radius of R34 from center C34, describes an arc A34 during this motion. Similarly, in moving from position 41.1 to position 41.2 the horizontal bar 41 of the fixed contact member 22 rotates about a center located substantially at point C41 on the surface of circuit board 32, and the bar 41, which is located at a radius of R41 from center C41, describes an arc A41. When intial contact is made (positions 34.1 and 41.1), point T1 on the arm 34 is the point of tangency with bar 41. But as the motion continues, the difference in the locations of centers of rotation C34 and C41, and the difference in the lengths of radii R34 and R41, cause bar 41 to slide longitudinally along arm 34 until, by the time the final positions 34.2 and 41.2 are reached, the new point of tangency is T2 on arm 34. Thus a small, gentle sliding wipe occurs during the making of the two contacts. And when the contacts break, the reverse motion causes a similar wiping in the opposite direction. This helps to keep the contact surfaces clean, which is highly desirable; but the stiffness of the fixed contact wire is great enough so that its deflection between the initial and final positions is small, and also occurs at a slow pace. As a result, there is no contact bounce, and no signal interruption or double keying.

In addition, the only contact pressure involved is that which is supplied by the inherent spring bias exerted on arm 34. The key 10, which is in the process of uncoupling from arm 34, does not drive the two elements 34 and 41 into engagement, and therefore excess contact wipe and high contact pressures are avoided.

The spring force exerted by arm 34 determines the contact pressure. This spring force can easily be adjusted, if necessary, by releasing the arm 34 temporarily from capture by both the actuator 36 and the horizontal contact bar 41. To accomplish such release, it is only necessary to manually move the arm 34 downwardly to its lower phantom position, as indicated by arrow 72 in FIG. 8. Once the arm is below the tines 42 and depending tip 41A, it is moved sidewardly and then upwardly, as indicated by arrow 74, to its upper phantom position in FIG. 8. (The coil turns 26 are sufficiently resilient to permit both the vertical and horizontal motions of arms 34.) The arm 34 is thus released from the bar 41 (see the phantom position of FIG. 7), and can therefore be freely moved in a vertical plane to deform it slightly up or down. Such deformation changes its static position 34S (FIG. 2), and thus alters the resilient contact pressure which it will exert on bar 41 after being returned to its operating position. After this adjustment is completed, the arm 34 can be returned to its position of capture by bar 41 and actuator 36 by simply moving it in the reverse of the directions indicated by arrows 74 and 72.

The upper end 39 of the fixed contact 22 can also be slightly deformed in the vertical direction in order to alter the height of the point of switch contact engagement (position 34E in FIG. 2). There is an uppermost and a lowermost acceptable contact point which is specified in the design of a given instrument. If the actual contact point is found to be outside this acceptable range, the adjustment of the upper end 39 is a convenient way of bringing it within specifications. It is also a convenient way of selecting a preferred contact point at some higher or lower level within the permissible range.

Such adjustment also incidentally affects the contact pressure exerted upon bar 41 by arm 34, because less resilient force is developed by the arm when it is intercepted by the bar at a greater height (closer to its static position 34S), and more force is developed when it is intercepted at a lesser height (further from its static position). Nevertheless it remains true that, for a given adjustment of the height of bar 41, the contact pressure is determined solely by the spring force exerted thereon by arm 34, and is uninfluenced by over-travel of the key 10.

The upper end 39 can also be deformed slightly to the left or right in the horizontal direction (see the phantom positions in FIGS. 7 and 8) in order to displace the wear point and thus extend the useful life of the keyswitch mechanism after the precious metal coating begins to wear thin at one spot.

All these adjustments can be made on an individual keyswitch basis, because each fixed contact member 22 is dedicated exclusively to a particular moveable contact member 24 and key 10. This is an advantage, as compared to the type of keyswitch mechanism in which the fixed contact is in the nature of a common bus bar serving a plurality of individual keys and switches.

It will now be appreciated that the present invention provides an improved key-actuated switch mechanism for electronic musical instruments, in which the key is decoupled from the switch mechanism as soon as electrical contact is made. This prevents increase of contact pressure due to key over-travel, and avoids excessive wiping action and the possibility of double-keying, even if the musician should vibrate the key from side to side when it is in its fully actuated position.

The invention nevertheless features a small, controlled amount of contact wipe, uninfluenced by keyboard pressure. The contact pressure is only that which is produced by the inherent spring force of the contacts themselves, and that force is easily adjustable.

Re-coupling to the switch contact upon key actuation is done quietly, by virtue of the design and choice of material for the actuator member.

Improved techniques are also disclosed for securing the fixed and moveable contacts to a printed circuit board.

The described embodiments represent the preferred form of the invention, but alternative embodiments may be imagined which would come within the novel teachings herein. Accordingly, these embodiments are to be considered as merely illustrative, and not as limiting the scope of the following claims.

The invention claimed is:

1. A key-actuated switch mechanism comprising: a key; means mounting said key for motion between an actuated position and a released position; first switch contact means including a moveable element biased toward a static position; actuator means operable in response to release of said key to drive said moveable element toward a displaced position and operable in response to actuation of said key to permit said moveable element to return toward said static position; second switch contact means including a fixed element positioned to intercept said moveable element and thereby prevent the complete return of said moveable element toward said static position; said key being arranged so that, after said moveable element is intercepted by said fixed element, said key must travel further to reach said actuated position; said actuator means being arranged to decouple from said moveable element and to leave said moveable element biased against said fixed element upon said further travel of said key; and means biasing said key toward said released position so that upon termination of key actuation said actuator means returns said moveable element to said displaced position.

2. A switch mechanism as in claim 1 wherein: said first switch contact means comprises a resilient conductive wire; means for mounting a fixed end of said wire at a distance from said actuator means; and said moveable element comprises a free end of said wire extending away from said mounting means toward said actuator means; said wire flexing resiliently to allow said free end to move toward said displaced position in response to said actuator means; the inherent resilience of said wire biasing said free end toward said static position and against said fixed element upon said further travel of said key.

3. A switch mechanism as in claim 1 wherein: at least one of said switch contact means comprises a resilient conductive wire, base means are provided for mounting a fixed end of said wire, said wire is formed with curved means at a selected location on said fixed end thereof, and said base means has an aperture formed therein, said curved means being friction-fit within said aperture for mounting said wire on said base means.

4. A switch mechanism comprising:

electrical conductor means;

moveable switch means for making electrical contact with said conductor means, said switch means being mounted for movement between a first position in which said switch means is spaced apart from said conductor means and a second position in which said switch means is in contact with said conductor means, said switch means being biased toward said second position; and actuator means normally operative for maintaining said switch means in said first position, operative to allow said switch means to be biased to said second position in contact with said conductor means when said actuator means is actuated, operative to decouple from said switch means when said switch means reaches said second position and said actuator means continues to be actuated and operative to recouple with said switch means and to return said switch means to said first position when said actuator means is deactuated.

5. A switch mechanism comprising a base board having a selected thickness, said board having an aperture formed therein which extends through said thickness of said board, an electrical contact means including a resilient wire at least one portion of which is curved to form at least one full turn having a selected outside radius and is resiliently compressible to temporarily decrease said radius, said aperture being somewhat smaller than twice said radius in a direction parallel to said radius and said board thickness being somewhat less than said radius, said curved portion being friction fit within said aperture to assist in securing said contact means to said base board, the relative dimensions of said curved portion, aperture and board being such that the center of said turn snaps past said board upon insertion of said turn into said aperture and must be recompressed to extract if from said aperture.

6. A switch mechanism comprising base means formed with an aperture having a pair of diagonally opposite corners, and electrical contact means including a resilient wire curved at one point along its length to form a fractional turn, said curvature being received within said aperture and resiliently compressed between said corners whereby spring pressure is exerted for securing said contact means to said base means.

7. A switch mechanism comprising base means, fixed contact means, moveable contact means, each of said contact means having a first end secured to said base means and a second end spaced from said base means, said second end of said moveable contact means having a static position and being resiliently biased toward said static position, said second end of said fixed contact means being interposed to prevent said second end of said moveable contact means from reaching said static position, and means operable for driving said second end of said moveable contact means out of engagement with said second end of said fixed contact means and further away from said static position, and for thereafter releasing said second end of said moveable contact means to return to engage said second end of said fixed contact means, said second end of said fixed contact means having a normal position and being adapted to be moved slightly from said normal position by said moveable contact means when contacted thereby, such slight movement being in a direction to cause a slight wipe between said contacts.

8. A switch mechanism as in claim 1 wherein said moveable contact means includes a resilient wire coiled to form at least one turn connecting said first and second ends thereof whereby said second end is movably mounted relative to said first end.

9. A switch mechanism as in claim 1 wherein said driving means is moveable between first and second positions, and when moving from said second to said first position said driving means is effective to drive said second end of said moveable contact means out of engagement with said second end of said fixed contact means, and when moving from said first position to said second position said driving means releases said second end of said moveable contact means and over-travels substantially beyond the position it occupies when said second end of said moveable contact means re-engages said second end of said fixed contact means.

10. A switch mechanism as in claim 9 wherein said driving means includes actuator means arranged to engage said second end of said moveable contact means during said driving phase and to de-couple from said moveable contact means during said over-travel phase.

11. A switch mechanism as in claim 10 wherein said actuator means includes an impact-absorbing body of noise-deadening material positioned to absorb the impact upon driving engagement with said second end of said moveable contact means.

12. A switch mechanism as in claim 11 wherein said noise-deadening material is shaped to define an edge at the point of said impact, and said edge is so oriented relative to said second end of said moveable contact means as to minimize the surface area involved in said impact.

13. A switch mechanism as in claim 11 wherein said driving means includes finger-responsive means formed of a relatively hard material, said noise-deadening material is relatively yieldable, said impact-absorbing body and said finger-responsive means are shaped to interengage with each other and incliude respective means which snap together for latching said impact-absorbing body to said finger-responsive means, and said noise-deadening material is so located as to yield upon assembly or disassembly of said finger-responsive means and said impact-absorbing body in a manner to allow said latching means of said impact-absorbing body to be displaced whereby to facilitate engagement with and disengagement from said latching means of said finger-responsive means.

14. A switch mechanism as in claim 13 further comprising means manually engageable for flexing said noise-deadening material in a manner to displace said latching means of said impact-absorbing body from said latching means of said finger-responsive means upon said disassembly.

15. A switch mechanism as in claim 10 wherein said actuator includes a pair of tine means located on opposite sides of said second end of said moveable contact means and extending sufficiently far to trap said second end between them even during said over-travel phase.

* * * * *